United States Patent [19]

Franek et al.

[11] 4,387,747

[45] Jun. 14, 1983

[54] FILLING OF CONTAINERS

[75] Inventors: Josef T. Franek, Chorleywood; Paul Porucznik, St. Albans; Alan E. Styles, Wantage, all of England

[73] Assignee: Metal Box Limited, Reading, England

[21] Appl. No.: 276,360

[22] PCT Filed: Sep. 10, 1980

[86] PCT No.: PCT/GB80/00140

§ 371 Date: Jun. 17, 1981

§ 102(e) Date: Jun. 17, 1981

[87] PCT Pub. No.: WO81/01138

PCT Pub. Date: Apr. 30, 1981

[30] Foreign Application Priority Data

Oct. 27, 1979 [GB] United Kingdom ..... 7937323

[51] Int. Cl.[3] ..... B65B 3/04; B65B 1/14

[52] U.S. Cl. ..... 141/1; 141/34; 141/163; 141/164; 141/191; 198/480; 414/224

[58] Field of Search ..... 141/1, 34, 113, 135, 141/144, 163–165, 168, 171, 173, 176, 181, 183, 191, 281; 198/480, 481; 414/224

[56] References Cited

U.S. PATENT DOCUMENTS 2,444,155 6/1948 De Back ..... 141/163 X

FOREIGN PATENT DOCUMENTS 123353 10/1901 Fed. Rep. of Germany .

*Primary Examiner*—Frederick R. Schmidt

*Attorney, Agent, or Firm*—Diller, Ramik & Wight

[57] ABSTRACT

A high-speed rotary filling machine, for filling containers with carbonated beverages or other flowable substances, has a turret (38) mounted on a horizontal axis (31). The containers (30) are carried in radially-extending positions around the circumference of the turret, open ends facing inwards, and are filled by conventional filling valves (43) within the turret. The centrifugal effect of rotating the turret at high speed is utilized to enable filling to take place over an arc of rotation approaching 360°. Spillage problems due to centrifugal effects are avoided by transferring the containers to a linear exit conveyor (58) tangentially at the lowest position (19) of turret rotation, without changing the linear velocity of the container.

11 Claims, 5 Drawing Figures

FILLING OF CONTAINERS

FIELD OF THE INVENTION

This invention relates to methods and apparatus for the filling of a succession of substantially identical containers with a flowable product, the method comprising rotating each container along a circular path about an axis of rotation remote from the container whilst introducing the flowable product into the container through an open end thereof from a filling head rotating with the container. Such a method will be called herein a "rotary filling method".

The apparatus to which the invention relates is for performing such a rotary filling method, and comprises a main turret, drive means for rotating the main turret continuously about its own axis, and a plurality of container holding means carried peripherally by the main turret, the main turret having the same plurality of container filling heads, for introducing the flowable product into a container held by the holding means and moving along the said circular path. Such an apparatus will be called herein a "rotary filler".

It will of course be understood that the term "container" herein means a vessel having an open end and a closed end, intersected by a central axis of the container. The container for the purposes of the invention is typically cylindrical, and is preferably a metal can, but it may instead be of any other axisymmetrical shape, e.g. frusto-conical or of a so-called "irregular" cross-section such as oval.

BACKGROUND ART

Rotary fillers and filling methods, both within and outside the above definitions, are commonly in use for the filling of containers of many different kinds, with flowable products which may be in the form of free-flowing (low-viscosity) liquids, viscous liquids such as paint, dry solids in powder or granular form, or products containing both solid and liquid. Although the present invention is applicable to all kinds of flowable product and to most kinds of container, it is concerned primarily with the solution of a problem which is found to arise only where high-speed filling is required. Many container filling operations do not call for high filling speeds, and, indeed, a very great variety of products is introduced into containers, such as cans, bottles, flexible tubes, large tins etc., by relatively low-speed fillers whose operation is rotary (in the sense that a succession of containers is moved along a circular path by a turret, and filled during this movement) but which normally have stationary filling heads so that the turret is moved by an indexing mechanism from one station to another in intermittent motion. Such machines are outside the scope of this application and are mentioned only in order to help identify the field of the present invention, which is concerned with high-speed fillers having continuously-rotating filling heads operating on containers which are themselves in continuous rotation.

In a typical rotary filler, of known kinds, whether or not falling within the definition of a rotary filler as set forth hereinbefore, the main turret rotates about a vertical axis and the containers to be filled are carried upright, with their open ends at the top, on and by the rotating turret. Filling takes place primarily by gravity in the case of solids or unpressurised liquids. In the case of liquids to be introduced into the container under pressure (for example beer and other carbonated drink products), the filling head engages against the open end of the container so as to form a pressure seal during the filling operation. Whilst this system works quite satisfactorily at low speeds, problems arise if the speed is increased. In high speed, nonintermittent, rotation, the influence of centrifugal force on the liquid in the container becomes more significant, and the maximum speed of rotation obtainable in practice is consequently limited by the tendency of this force to cause spillage of the liquid at the instant at which the container is transferred to a linear or rotary conveyor leading from the filler to the next stage, which is a closing machine for closing the container. This effect is accentuated when filling takes place under pressure because at the instant when the container is disengaged from the filling head, the release of applied pressure within the container allows centrifugal force to take full effect suddenly, thus greatly increasing the risk of spillage.

If the speed of rotation is further increased, the horizontal, radial, centrifugal acceleration acting on the liquid may become sufficiently great, in relation to the acceleration due to gravity, for the surface of the liquid in the container to become inclined to the horizontal by an angle so steep that spillage will occur at the radially-outward edge of the open end of the container even during the filling operation, i.e. before the container is completely filled. Although this effect can be overcome by mounting the container on the turret at an angle to the vertical such as to compensate for this tilting of the liquid surface, such a solution itself gives rise to further problems in attempting to effect a smooth transition, without spillage, from the tilted attitude of the container during filling to an upright attitude upon its removal from the turret of the filler. A carefully-designed transition path is necessary in order to achieve this, and suitable means must be provided for ensuring that the container is moving at a particular predetermined speed for which the transition path has been designed. The operation of a filler with tilted cans is also itself limited to a single design speed, viz. the particular speed at which the plane of the liquid surface under the influence of centrifugal force is approximately normal to the container axis.

DISCLOSURE OF THE INVENTION

It will be appreciated from the foregoing that serious problems due to the effects of centrifugal acceleration in a high-speed rotary filler, lie in the prevention of spillage as the filled container leaves its circular, rotational path, i.e. when it changes direction.

According to the invention in a first aspect, there is provided a rotary filling method (as hereinbefore defined) in which the axis, remote from the containers, about which the containers are rotated, is horizontal, each container being held so that its axis extends radially with respect to the said axis of rotation with the open end of the container as the radiallyinnermost end thereof, flowable product being urged radially outwardly into each container via the appropriate filling head during its rotation through an arc of the circular path at a velocity such that, over the whole of said arc, the resultant force on the flowable product in the container due to centrifugal and gravitational accelerations is in a direction tending to urge the product towards the closed end of the container, the filled container being removed from said circular path, in a direction tangential to the circular path, at a container release position in which the container has its open end generally uppermost.

The rotational velocity of the main turret is preferably substantially constant. Nevertheless, even where the filler is arranged to operate at constant speed, the rotational velocity is variable in the sense that it changes when the machine is started, until the constant operating speed is reached, and when it is stopped. According to a preferred feature of the invention, therefore, in a method according to the invention wherein the rotational velocity is variable, the flowable product is urged into each container at a constant flow rate irrespective of the rotational velocity of the container along said circular path, the rotational position of the container at which filling thereof commences being governed by the said rotational velocity so that filling terminates at a predetermined rotational position irrespective of the rotational velocity.

This effect may be achieved for example by means of a mechanical centrifugal governor, responsive to rotational speed and controlling the operation of the filling heads, or by a suitable electronic control system whereby the filling heads are actuated by signals from speed-sensitive control units based on microprocessors. The effect of such an arrangement is that no container is supplied with the flowable product except whilst it is in an arc of the circular path in which the length of that arc may be changing, the arc being one in which the aforementioned resultant force on the flowable product is in a direction tending to urge the product towards the closed end of the container. Thus, at start-up the first container is filled whilst moving slowly through a small arc and the next whilst moving more quickly through a slightly larger arc, and so on. This enables the filler to be operative during acceleration to its operating speed and deceleration therefrom. It also enables the filler to be operated at a reduced output speed without being stopped, as may be necessary for example in the event of a temporary fault in the closing machine, or in other circumstances causing a temporary accumulation of filled containers downstream of the filler. In these ways, production can be maintained at a higher overall figure than if the filler had to be stopped for reasons other than a fault in the filler itself.

According to the invention, in a second aspect, in a rotary filler (as hereinbefore defined) the main turret axis is horizontal, each container holding means being adapted so to hold a container to be filled that the container extends from its open end, radially outwardly with respect to the main turret axis, and to release the container in a container release position, in which the container has its open end generally uppermost, for removal in a direction tangential to said circular path, and each filling head being carried by the turret and arranged to allow said flowable product to be urged radially outwardly into the container. Preferably the container release position is the lowest position on the main turret, so that the axis of a container at that position is vertical. The filler may be supplied with container removal means, typically in the form of a suitable continuously-movable linear conveyor having means for holding the filled containers in controlled movement, for removing each successive container at the release position. The removal means may on the other hand be a separate unit from the filler itself. In either case, where at the release position the container axis is vertical, the removal means is arranged to remove the containers in a horizontal direction. The effect of this preferred arrangement, at the container release position, is that the liquid surface in the container is level because both the centrifugal acceleration and the acceleration due to gravity take place vertically downwards. Furthermore, it will be realised that it is at the lowest position on the main turret that the resultant force on the liquid has its greatest value. This is precisely the effect that is the most desirable if this lowest position is made to be the release position, since it is of course at the release position that the container is full, the liquid surface being nearest to the open end of the container and therefore most susceptible to spillage.

As the filled container is removed horizontally, in a direction tangential to its previous circular path, the resultant force on the liquid is of course reduced by the amount of the centrifugal force; but being due to gravity the resultant force remains substantially vertical, unless subject to a horizontal component due to the inertia of the liquid if any change takes place in the linear velocity of the filled can in its transfer from the turret to the conveyor or other removal means which receives it from the turret. In order to ensure that this transfer shall be smooth and without change in linear velocity, the container removal means preferably comprises a linear conveyor synchronised with the main turret of the filler.

It is however to be understood that the release position need not be precisely at the lowest point on the turret, but may be to either side of this point so that the containers are removed in a path initially slightly inclined to the horizontal. This is possible where the flowable product is, for example, a powdered or granular solid, or even where it is a liquid, and where a substantial ullage space is left above the surface of the product.

It will be realised that the invention proposes an important and fundamental change, not only in the manner in which each filled container is moved in order to overcome the problems due to centrifugal accelerations at the point where it leaves the filler main turret, but also in the attitude of the container during the filling operation. Whereas in the known fillers discussed above, the containers are rotated about a vertical turret axis and are either upright or tilted (but with their open ends still uppermost) during filling, in a rotary filler according to the present invention the axis of each container is radial to the axis of rotation, remaining in a single vertical plane throughout the filling process. Furthermore, the open end may not be uppermost at all times. Indeed, filling should if possible take place over as great a part of a single revolution of the main turret as possible, so that it is desirable that the flowable product be introduced into the container even when the latter is upside down. This surprising effect is in fact achieved in the filler of the present invention, by utilising to advantage that centrifugal force which in the above-mentioned known fillers is actually a source of serious disadvantages, notably that of limitation of the speed achievable in practice. The main advantage obtained by the present invention, in respect of the filling operation itself (as well as in the transfer of the filled containers from the turret), is that of high-speed operation, and the means of achieving this result is to ensure that the speed of rotation of the turret is such that, at every position in which a container containing or being filled with flowable product is located on the turret, there is a resultant force, due to the combined effects of centrifugal and gravity accelerations, tending to drive the product away from the open end of the container.

Thus, for example, at the topmost position, i.e. where the container is upside down with its axis vertical, filling can take place provided that the centrifugal acceleration is at least slightly greater than that due to gravity.

Containers are supplied to each successive container holding means of the main turret by any suitable feed device. However, preferably this feed device consists of a feed turret, rotatable in synchronism with the main turret but about its own axis, the feed turret being arranged to feed the successive containers to their respective holding devices as the latter reach, in turn, a predetermined container-receiving position in the rotation of the main turret. The preferred configuration of the container feed turret is one which is effectively frustoconical, i.e. it moves each container through a circular path such that the surface of revolution generated by the container axis is a frustum of a cone having its apex at the intersection of the main turret axis with a line, radial of the main turret, such that this latter line is coincident with the container axis when the container is held by the holding means. This arrangement ensures that the containers are placed opposite the corresponding filling devices in the correct geometrical relationship; and to this end, in the preferred arrangement, the axis of the container feed turret is inclined to that of the main turret, the feed turret being arranged to hold each container in an orientation of the latter such that the container axis makes an angle with the feed turret axis complementary to that between the axes of the two turrets.

The container-receiving position is preferably that in which the container lies on a horizontal axis when positioned in the container holding device, the latter being in upward movement as the main turret rotates, the axis of the container feed turret being horizontal.

The several container-holding means are equally spaced around the turret. Preferably each of these means comprises radially outwardly-facing means for engaging a container about the open end of the container, and a container retaining member movable between a retracted position, not in engagement with the container, and a holding position radially outwards of the radially outwardly-facing means, in which latter position the outwardly-facing means co-operates with the retaining member to hold the container between them with the retaining member engaging the closed end of the container. Each of the said container-retaining members is preferably mounted on the main turret in such a way that it can pivot about a radial axis, for example in response to actuation by a fixed cam, so as to move between its retracted position and its holding position.

The preferred configuration of a container-holding means lends itself to adoption of a further advantageous feature, viz. that the filling head itself may constitute the said outwardly-facing means, so that the container is introduced into endwise engagement with the filling head and the retaining member is then moved into its holding position so as to hold the container against the filling head for the filling operation.

The filling heads are of any suitable kind. Where the containers are to be filled under pressure, the filling heads are preferably of the known kind in which a filling valve, or a valve sleeve surrounding a filling valve, is moved axially into sealing and clamping engagement with the open end of the container, the interior of the latter then being pressurised and filling then taking place through the valve. Such a filling head can of course also be used where non-pressurised filling is required.

It will be realised from the foregoing that the invention, by providing for radial filling of containers which are being rotated, whilst radially mounted, about a horizontal axis, not only enables spillage problems due to centrifugal accelerations to be substantially eliminated, but also utilises centrifugal acceleration to permit higher speeds of operation to be achieved than have hitherto been possible, at least with equipment of equivalent simplicity of construction to the apparatus of the present invention.

It will also be understood that the invention is applicable to the filling of most types of packaging container such as metal cans, glass or plastics bottles or pots. It is however particularly applicable to metal cans and other wide-mouthed containers where spillage upon completion of the filling operation is a hazard.

One embodiment of a rotary filler and rotary filling method, according to the invention, will now be described, by way of example with reference to the drawings hereof.

SPECIFIC DESCRIPTION

Figure 1:
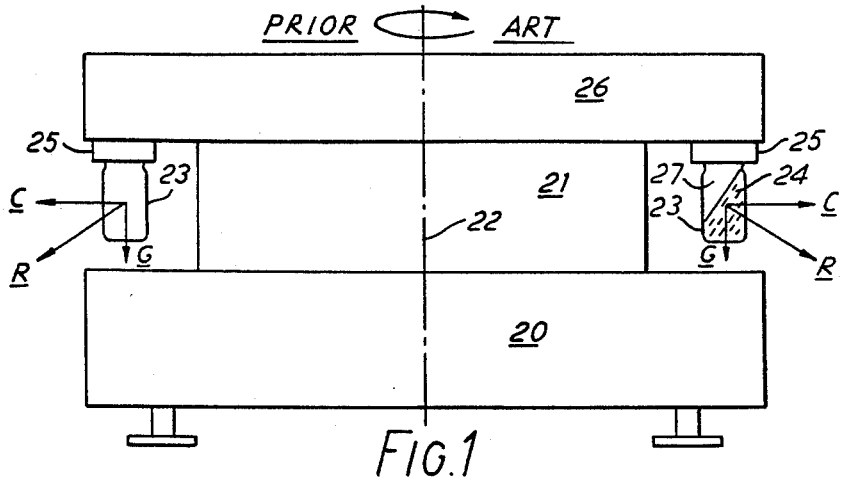
FIG. 1 is a diagrammatic elevation of a known type of filler, illustrating how centrifugal acceleration introduces limitations overcome in the filler illustrated in the other Figures.

In the prior art rotary filler whose operation is illustrated in FIG. 1, a fixed base 20 carries a continuously-rotating main turret 21 which is driven about its own vertical axis 22. A succession of empty cans 23 are fed into the rotary filler, to be held with their open ends uppermost (by means not shown) and carried around by the main turret 21. Whilst being carried by the turret, each can is filled with a flowable product 24 (for example beer) by a respective one of a plurality of suitable filling heads 25 in the upper part 26 of the main turret. As the main turret is rotated at constant speed, the liquid in the cans is subjected to a radial force C by virtue of a constant centrifugal acceleration. In FIG. 1, the radial force C and gravitational force G are represented by vectors as is the resultant force R, the direction of which depends on the magnitude of the centrifugal acceleration. The faster the main turret 21 rotates, the smaller will be the angle between the vector R and the vector C. The surface of the liquid 24 is normal to the vector R. Consequently the speed of rotation is limited to a maximum value which is the speed at which the inclined surface of the liquid reaches the top of the can when the required amount of liquid has been introduced. This condition is seen in the right-hand one of the two cans shown in FIG. 1. It follows that, if a reduced amount of ullage space 27 is required, either the speed of rotation of the main turret must be reduced or its diameter increased. If a higher speed is required (and therefore higher output rates), for a given amount of liquid per can, the diameter of the turret and the number of filling heads must be increased. This increases the capital cost of the machine and is wasteful of materials, besides increasing the weight of the main turret and necessitating stronger bearings, with increased problems of wear, lubrication, alignment etc., and an increase in the time and cost of maintenance and in lost production whilst the filler is stopped for maintenance or repair.

The apparatus now to be described with reference to FIGS. 2 to 5 is a rotary filler for filling a succession of substantially identical open-topped cans 30 with a flowable product, in this example beer. The method performed by the filler comprises rotating each can 30, in the direction indicated by the arrow A in FIG. 2, along a circular path defined in part by nineteen positions 1 to 19, about an axis 31 remote from the cans, whilst introducing beer into the cans as will be described hereinafter.

The filler comprises a fixed main frame 32 comprising a pair of upright frame units 33,34 supported on a bedplate 35. The rear frame unit 33 carries a main bearing housing 36 in which are mounted main bearings 37. A main turret 38 of the filler is in the form of a wheel 39 having a hollow shaft portion 40 which is rotatable in the housing 36 by the bearings 37, so that the main turret is rotatable about its own horizontal axis 31.

Figure 3:
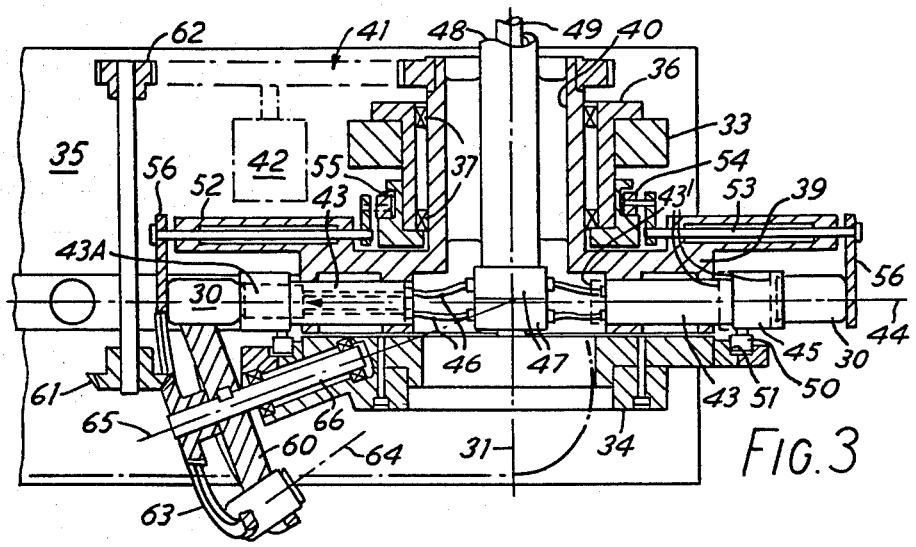
FIG. 3 is a simplified sectional plan view, taken on the line III—III in FIG. 2.

The main turret shaft portion 40 is coupled, through transmission gears indicated diagrammatically at 41 in FIG. 3, with a main drive motor 42, which is of a constant-speed type and which drives the main turret in continuous rotation.

The main turret wheel 39 has twenty-four filling heads 43, each mounted on a radial axis such as the axis 44 (FIG. 3). The filling head axes are equally spaced, and each head 43 is of the known kind, having a filling valve and a sleeve portion 45, facing radially outwards and adapted to engage sealingly around the open end of a can 30 so that the latter can be filled with beer under internal pressure. The filling heads 43 are connected, through suitable pipes 46 and manifolds 47, with a common beer feed pipe 48 and air extraction pipe 49, the pipes 48 and 49 being fixed within the main turret shaft portion 40 and connected in conventional manner, by suitable means not shown, to a source of beer and to an air outlet, respectively. The means by which the beer is supplied to the filling heads, and the manner in which its pressure is controlled, are well known in the art and need not be described in detail herein. Similarly the operation of the filling valve in each of the heads 43 is well known and calls for no description here.

Each filling head 43 is mounted for limited sliding movement in the main turret 38 in a radial direction between a retracted position and container-engaging position. In FIG. 3 two of the heads 43 are shown; the left-hand one of these is seen in an intermediate position in which it has just started to move radially outwardly from its retracted position, whilst the right-hand head is in its container-engaging position with its sleeve 45 embracing the open end of a can 30. Movement of each filling head 43 between its retracted and its container-engaging position is effected by means of a cam follower 50, carried by the filling head and engaging a fixed cam track 51 of suitable profile, the latter being carried by the front fixed frame unit 34 of the filler. Thus each filling head 43 is moved into and out of its container-engaging position, respectively, once in every revolution of the main turret, as will become clearer hereinafter.

The rear face of the main turret wheel 39 has twenty-four equally-spaced hollow pillars 52 extending radially. Extending through each of the pillars 52 is a pivot shaft 53 having at its radially-inner end a lever carrying a cam follower 54. The cam followers 54 engage in a second fixed cam track 55, which is coaxial with the main turret and which is formed in a cam member suitably mounted in a fixed position. In this example this cam member is secured to the fixed main bearing housing 36. The outer end of each pivot shaft 53 carries a container-retaining member in the form of a can support plate 56. The fixed cam track 55 is so profiled that, as the main turret rotates, each can support plate 56 is moved pivotally by its respective cam follower 54 between a retracted position and a holding position, once in every revolution of the main turret. In FIG. 3 the right-hand one of the two can support plates 56 shown, and in FIG. 4 the extreme right-hand one of the plates 56 shown, are seen in this holding position.

It will be observed that, in its holding position, the can support plate lies radially outward of the corresponding filling head 43. In this position, as is best seen in FIG. 3, the can support plate 56 co-operates with the filling head sleeve 45 to hold the can 30 between them, with the plate 56 engaging the closed end of the can. The filling head and can support plate thus constitute together a container holding means, carried peripherally by the main turret 38 and so arranged that each can is held, for and during the filling operation, with its open end facing radially inwardly and with the can extending radially outwardly therefrom, with respect to the main turret axis 31. Furthermore, the axis of the can coincides with the radial axis 44.

Figure 4:
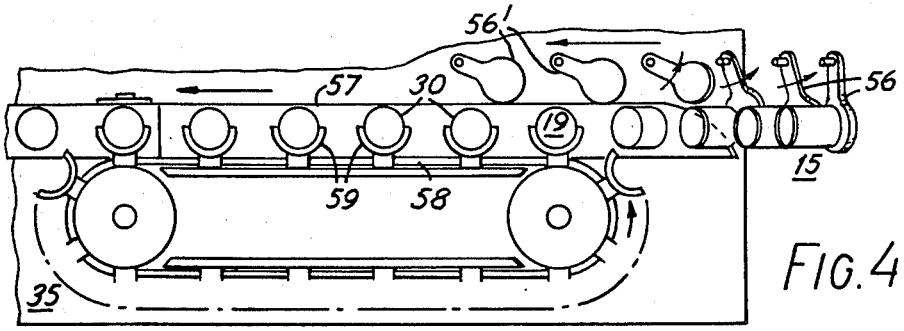
FIG. 4 is a simplified plan view with the main turret and some other parts of the filler removed, so as to illustrate how each can is released from the main turret and removed from the filler.

In the retracted position of a can support plate 56, the latter is clear of the can, as is best seen in the support plates indicated at 56' in FIG. 4.

Mounted on the baseplate 35 of the filler is a fixed conveyor support plate 57 upon which there is a container removal means in the form of an exit conveyor 58 of the endless-belt type, having equally-spaced pockets 59 for holding one can 30 in each pocket. The exit conveyor 58 is driven, through a suitable drive transmission means (not shown), by the main motor 42 of the filler, so that its operation is at all times in synchronism with the rotation of the main turret 38. The conveyor 58 is furthermore so phased that each pocket 59 will engage a respective can 30 when the latter is in a container release position which, in this example, is the lowest position, 19, on the main turret. In this position the axis of the can is of course vertical and the can is therefore removed by the conveyor 58 from the main turret in a horizontal direction. It is however to be noted that the exit conveyor must remove each can in a tangential direction from the main turret; thus if, for example, a can were removed from position 18 instead of from position 19, the exit conveyor would be inclined downwardly away from position 18 at an angle of 15°, i.e. the angle between the can axis and the vertical at that position.

Figure 2:
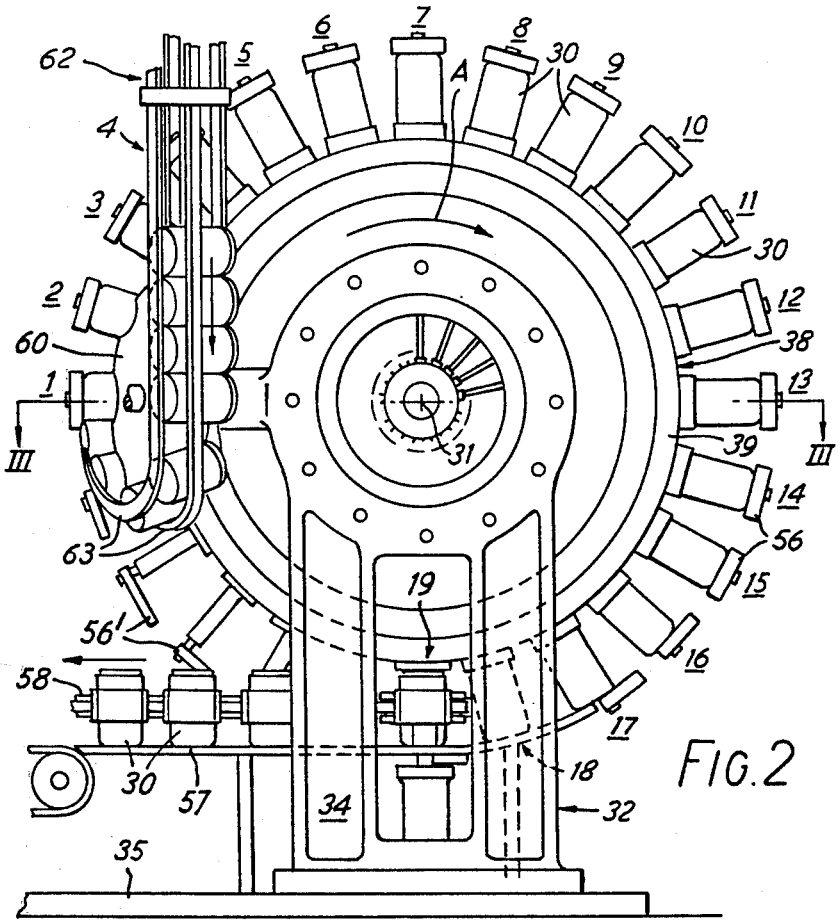
FIG. 2 is a simplified side elevation of the rotary filler according to the present invention, arranged for filling open-top metal cans with beer.

Cans 30 are fed in succession to the main turret 38 at a container-receiving position of the latter which, in this example, is the position 1, in which the can axis is horizontal and that part of the main turret is ascending. Feeding is accomplished by means of a can feed turret 60, which is driven in synchronism with the main turret 38 by the main motor 42 of the filler through gears 61. The can feed turret 60 has peripheral pockets, each for engaging a can, and as it rotates it receives the cans one by one into its pockets from a vertical magazine 62. Upon further rotation, the cans are carried around by the feed turret 60, being supported by suitable curved rails 63 until each successive can is presented by the feed turret into the radial space between the particular can support plate 56 and filler head 43 which are at the same time arriving in position 1 (FIG. 2).

As can be seen best in FIG. 3, the general configuration of the can feed turret 60 is frusto-conical, in that the can-engaging pockets are arranged to hold each can 30 in orientations such that, as it is moved through a circular path between the magazine 62 and the feed position 1, the can axis 64 generates a surface of revolution in the form of a frustum of a cone. The apex of this cone is at the intersection of the main turret axis 31 and the radial axes 44. Accordingly, the axis 65 of the can feed turret 60 is itself inclined with respect to the axis 44 by an angle equal to the half-angle of the cone and complementary to the angle between the two turret axes 31,65. The can feed turret is mounted on a shaft 66 mounted in bearings which are carried by the front frame unit 33 of the filler.

In operation, the main turret 38 is driven at a rotational velocity which is constant, cans 30 being fed successively to successive can hold devices 56,43 at position 1 in the manner just described. As each can is received in the radial space between the support plate 56 and filling head 43, the support plate is moved into its can-holding position by the fixed cam 55, and, at the same time, the filling head is moved by the other fixed cam 51 into engagement with the open end of the can, thus securing the can to the main turret ready to be filled with beer.

Figure 5:
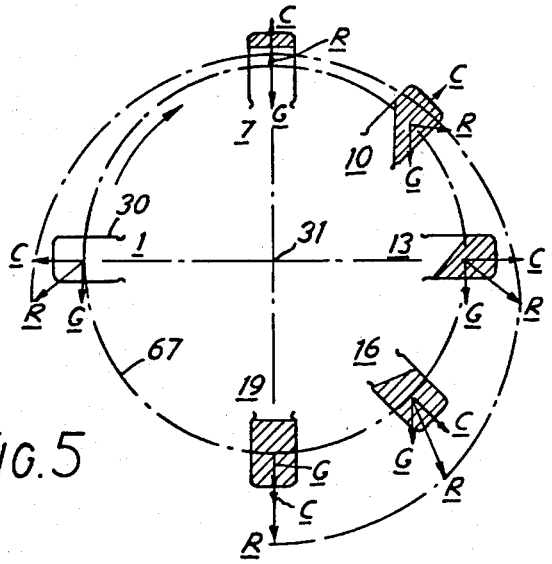
FIG. 5 is a diagram, in the same side elevation as FIG. 1, illustrating the effects of centrifugal acceleration in the operation of the filler shown in FIGS. 2 to 4.

Reference is now made to FIG. 5, which illustrates diagrammatically the effects of centrifugal and gravitational forces on the contents of cans 30 being filled in the filler under discussion.

Vectors indicating centrifugal and gravitational accelerations, C and G respectively, are drawn from a base circle 67 having the main turret axis 31 as its centre. It will be noted that the centrifugal acceleration C is slightly greater than the gravitational acceleration G in this example, the rotational velocity of the main turret 38 being chosen so that this is so. The resultant acceleration R, also denoted by vectors in FIG. 5, always has, under these conditions, a component which is directed radially outwards. In this manner, the resultant force due to the variable acceleration R is in a direction tending to urge beer in the can always towards the closed end of the latter.

Under these conditions, filling can be carried out through the whole of the arc of the circular path traversed by the can, i.e. filling may commence as soon as the can has been secured to the main turret at position 1, and terminate immediately before the can reaches the release position 19. FIG. 5 shows partially-filled cans at positions 7, 10, 13 and 16. It is to be noted that, because during filling the mass of liquid in the can is increasing, the resultant force acting thereon is increasing, as the main turret rotates beyond the uppermost position 7, at a greater rate than the increase in the resultant acceleration; thus, as the can is filled, the forces tending to stabilise the liquid are increasing, so lessening the danger of spillage. At each of the positions shown in FIG. 5, the can is seen filled to substantially the maximum depth possible without spillage. Since, however, the rate of increase of the resultant acceleration R after the uppermost position 7 is not constant at constant rotational velocity, in order to achieve the abovementioned effect it is necessary to vary the flow rate through each of the filling heads 43. This may be done by provision of a suitable auxiliary valve associated with the filler and operated by a further fixed cam, not shown, However, it is more convenient in practice to adopt a substantially constant flow rate, the value of which is chosen so that at no point during the filling operation does the free surface of the liquid quite reach the lip of the can. Then there will be some points at which the free surface is some way from the lip.

At the release position 19, the free surface of the beer in the now-filled can 30 is horizontal, and the linear velocity of the exit conveyor 58 is substantially the same as the tangential velocity of the open end of the can at this position. Thus, as the filled can is received by the exit conveyor, substantially no change takes place in the linear velocity of the open can end, and therefore of the free surface of the beer, the can being smoothly transferred to the conveyor without its axis leaving the vertical plane in which it has been during the filling operation.

FIG. 4 illustrates the operation of successive can support plates 56 (actuated by their cam followers 54 and fixed cam track 55) in moving to their retracted position 56′ so as to release the filled cans 30 before the latter are received by the exit conveyor 58. The conveyor support plate 57 is, for this purpose, extended beyond the position 19 and curved (as shown in FIG. 2) so as to support the cans upon retraction of the support plates 56. The fixed cam 51 also causes each filling head 43 to be retracted upon completion of the filling operation, whilst the corresponding can support plate is being retracted and before the can reaches the release position 19.

In the mode of operation just described, filling takes place during rotation of the can through an arc of its circular path (represented by the base circle 67 in FIG. 5) such that the arc subtends nearly 270° and includes the position 7 and adjacent positions in which the can is actually upside down whilst being filled. It is necessary that during filling, the arc through which it is rotating should be such that the resultant acceleration R is always in a direction tending to urge the product towards the closed end of the can. Conversely, however, it is true that so long as this criterion is satisfied for the resultant acceleration, and so long as the can is properly held in its radially-extending position on the main turret, filling can take place. This is so whether or not the abovementioned criterion is in fact satisfied at or near the top of the main turret.

In other words, if the rotational velocity is sufficient for there to be a radially-outward component of resultant acceleration during only an arc of rotation, for example, of less than 180° terminating at the release position 19, it is still possible successfully to introduce beer into the can. Furthermore, if the flow rate of beer through each filling head 43 is constant, and independent of the rotational velocity, the can will be filled in a given time regardless of the extent of the arc through which it has travelled. Consequently it is possible to continue filling cans already on the main turret whilst the latter is decelerating to standstill, for example at the end of a shift or if the filler has to be stopped for any other reason. Similarly cans can be filled successfully whilst the filler is accelerating to its normal speed on start-up.

In order to ensure that when the main turret is rotating at less than its normal constant speed, each can reaches the release position 19 filled with the correct amount of beer, the rotational position at which the filling operation commences is made to be variable in response to rotational velocity, so that filling (at a constant flow rate) always terminates at the same position, at or approaching the release position 19. This may be achieved by providing a suitable speed-responsive governor valve (not shown) in each of the filling heads 43, or in the feed pipe 46 leading to each of the filling heads. Such a governor valve may be of a kind operated mechanically by centrifugal force, for example by means of a weighted arm coupled with the valve member.

It will be appreciated that other modifications may be made to the filler described. For example, output may be doubled by providing two rows of filling heads 43 and can support plates 56 on the main turret, instead of only one as shown. Two exit conveyors and two feed turrets, each with its own magazine, will then be provided. Such an arrangement can conveniently be realised, for example, by providing a second wheel 39 of the main turret at the end of the shaft portion 40 opposite that at which the first wheel 39 is situated. Further shaft portions and wheels may similarly be incorporated if required, the main turret axis 31 and the drive system being common to the whole of the resulting multiple-row main turret.

The cans need not be introduced at the position 1, 270° of arc before the release position, but may be introduced at any convenient position in the rotation of the main turret, for example intermediate between position 19 and position 1 so that the arc of rotation available for the filling operation, provided the rotational speed is high enough to permit continuous filling even at the topmost position 7, subtends an angle of greater than 270°. Similarly, the filling operation may be terminated before the can reaches the release position; for example, in the example shown in the drawings the operation on each can may be arranged to finish (by retraction of the filling head 43) at position 15, immediately before the can support plate 56 starts to retract.

It will be appreciated that a rotary filler according to the invention need not be arranged to fill containers with beer or other carbonated liquids, but may be adapted for filling with liquid or flowable solid substances (e.g. powder or granular matter) without the inside of the container being pressurised. Thus in the filler shown in FIGS. 2 to 4, the filling heads 43 may be replaced by simple filling valves arranged to discharge a liquid or flowable solid into the containers without making a pressure-tight seal against the latter. In that case the filling heads need not be in contact with the containers during the filling operation, and the only moving part of each filling head may be the valve member, controlled for example by the fixed cam track 51, which opens and closes the valve.

The fixed cam track 55 may be replaced by a fixed cam track profiled, in known manner, so as to move the can support plates 56 radially with respect to the main turret 38, instead of in pivoting movement as described. The exit conveyor 58 will then be modified, for example by providing magnetic or other gripping means in place of the simple pockets 59, so as to obviate the need for the fixed conveyor support platform 57.

We claim:

1. A method of filling a succession of substantially identical containers (30) with a flowable product, in which: (a) whilst each container is being rotated non-intermittently along a circumferential path (1–19) about a horizontal axis of rotation (31), the container being at the same time held with its axis (44) radial with respect to said path and with its open end facing radially inwards, the product is introduced into the container through said open end radially outwardly via a filling valve (43) rotating therewith, and (b) each filled container in succession is transferred, at a release position (19) in which its open end is generally uppermost, from the circumferential path to a linear path (57) tangential thereto, characterised in that: (c) flowable product is led to each filling valve in a generally radially outward direction; (d) the containers are rotated at a velocity such that, over the whole of an arc of the circumferential path followed by each container as it receives said product, a resultant force on said product due to centrifugal and gravitational accelerations of the product itself is always in a direction generally toward the closed end of the container, the product being caused to flow through the filling valve into the container by said resultant force (with or without the assistance of internal pressurization of the product) and the resultant force alone retaining the product in the container with a free surface perpendicular to the direction of said force; and (e) each filled container is transferred to said linear path with substantially no change in its linear velocity.

2. A method according to claim 1, characterised in that the flowable product is supplied to each container at a constant flow rate irrespective of the actual value of the velocity of rotation of the container at any instant, the rotational position of the container at which filling thereof commences being so governed by the rotational velocity that filling always terminates at a predetermined rotational position.

3. A rotary filler for filling a succession of substantially identical containers (30) with a flowable product, the filler comprising: a main turret (38) having a horizontal axis (31); drive means (41, 42) for rotating the main turret non-intermittently about its axis (31); a plurality of container holding means (45, 56) carried peripherally by the main turret and each adapted to hold a respective container with its axis (44) radial and its open end facing radially inwards; a filling means (46,43) associated with, and disposed in the main turret radially inwardly of, each respective holding means; and a generally-horizontal exit conveyor (57–59) below the main turret for receiving from the appropriate holding means each filled container in turn with its open end generally uppermost, characterised in that each filling means includes a filling valve and is so arranged as to allow flowable product to flow in a generally radially outward direction when the velocity of rotation of the main turret is sufficient to exert a centrifugal acceleration on said product such as to cause such flow, and that the exit conveyor comprises spaced-apart container-locating means (59) and means (58) for removing the filled containers with substantially no change in their linear velocity upon their transfer from the holding means (45, 56) to the conveyor.

4. A rotary filler according to claim 3, characterised in that each filling means comprises a filling head (43) including the respective filling valve, the container holding means comprising a radially-inner element (45) for engaging the open end of a respective container in co-operation with a radially-outer element (56) for engaging the closed end thereof, and that the filler includes first actuating means (50, 51) for retracting radially inwardly each radially-inner element (45) in turn at a first predetermined rotational position (1) of the main turret (38) in order to receive an empty container and again in a second predetermined rotational position (19) in the vicinity of the exit conveyor (57–59) in order to release the filled container.

5. A rotary filler according to claim 4, characterised in that each radially-inner element (45) is part of the filling head (43).

6. A rotary filler according to claim 4 or claim 5, characterised in that each radially-outer element (56) of the container holding means is a separate retaining member, mounted on the main turret pivotally about a radial axis, and that the filler includes second actuating means (54, 55) for moving each said retaining member about said axis thereof into and out of container-engaging position at said first and second predetermined rotational positions (1, 19), respectively.

7. A rotary filler according to claim 6 having a container feed turret (60) and means (61, 62) for rotating the feed turret in synchronism with the main turret (38) so as to feed a container (30) to each container holding means (45, 56) in succession as the latter reaches a first predetermined rotational position (1) in the rotation of the main turret, characterized in that the axis (65) of the feed turret intersects the axis (31) of the main turret and lies in a plane containing the main turret axis, the feed turret having peripheral pockets so profiled that a container held within any one of said pockets lies with its axis inclined to the feed turret axis by an angle complementary to the acute angle defined between the axes of the main and feed turrets.

8. A rotary filler according to claim 6 characterized by container feed means (60) arranged to feed successive empty containers to a respective container holding means (45, 56) when the latter reaches a position (1) substantially 270° behind the position (19) of transfer of the full container to the exit conveyor (57,59), with respect to the direction of rotation of the main turret (38).

9. A rotary filler according to any one of claims 3 to 5, having a container feed turret (60) and means (61, 62) for rotating the feed turret in synchronism with the main turret (38) so as to feed a container (30) to each container holding means (45, 56) in succession as the latter reaches a first predetermined rotational position (1) in the rotation of the main turret, characterized in that the axis (65) of the feed turret intersects the axis (31) of the main turret and lies in a plane containing the main turret axis, the feed turret having peripheral pockets so profiled that a container held within any one of said pockets lies with its axis inclined to the feed turret axis by an angle complementary to said acute angle.

10. A rotary filler according to claim 9 characterized by container feed means (60) arranged to feed successive empty containers to a respective container holding means (45, 56) when the latter reaches a position (1) substantially 270° behind the position (19) of transfer of the full container to the exit conveyor (57–59), with respect to the direction of rotation of the main turret (38).

11. A rotary filler according to any one of claims 3 to 5, characterised by container feed means (60) arranged to feed successive empty containers to a respective container holding means (45, 56) when the latter reaches a position (1) substantially 270° behind the position (19) of transfer of the full container to the exit conveyor (57, 59), with respect to the direction of rotation of the main turret (38).

* * * * *